US005303647A

United States Patent [19]

Seo et al.

[11] Patent Number: 5,303,647

[45] Date of Patent: Apr. 19, 1994

[54] PLATE FOR STENCIL PAPER PRINTING HAVING A RELEASABLE FILM

[75] Inventors: Keiji Seo, Nagoya; Mikio Imaeda, Bisai, both of Japan

[73] Assignee: Brother Kogyo Kabushiki Kaisha, Nagoya, Japan

[21] Appl. No.: 51,561

[22] Filed: Apr. 23, 1993

[30] Foreign Application Priority Data

May 27, 1992 [JP] Japan ..... 4-35340[U]
May 27, 1992 [JP] Japan ..... 4-135063

[51] Int. Cl.[5] ..... B41N 1/24
[52] U.S. Cl. ..... 101/125; 101/128.21
[58] Field of Search ..... 101/125, 127, 128.1, 101/128.21, 128.4

[56] References Cited

U.S. PATENT DOCUMENTS 3,799,053 3/1974 Rabelow ..... 101/125
4,961,377 10/1990 Bando et al. ..... 101/128.21

FOREIGN PATENT DOCUMENTS 125897 6/1986 Japan .
2238792 10/1987 Japan ..... 101/128.21
63-17074 1/1988 Japan .
2-169298 6/1990 Japan ..... 101/128.21
4-166390 6/1992 Japan .

*Primary Examiner*—David A. Wiecking
*Assistant Examiner*—Stephen R. Funk
*Attorney, Agent, or Firm*—Oliff & Berridge

[57] ABSTRACT

A stencil plate having a heat sensitive stencil paper sheet formed of a thermoplastic film and a porous support member, a non-woven fabric impregnated with ink, a frame member disposed so as to surround the non-woven fabric, an ink-impermeable film, and a peelable surface film having a high temperature heat resisting property that is superior to the thermoplastic film. The surface film may be a peelable member or there may be a peelable member adhered to the surface film so as to peel both, the peelable member having a projecting portion. When the projecting portion which projects from a frame member, is gripped and pulled, the surface film on a stenciled face, is gradually peeled away and removed from the stenciled face so that a heat sensitive stencil paper sheet in the stenciled condition is exposed.

20 Claims, 11 Drawing Sheets

PLATE FOR STENCIL PAPER PRINTING HAVING A RELEASABLE FILM

BACKGROUND OF THE INVENTION

1. Field of the Invention

This invention relates to a stencil plate.

2. Description of the Related Art

Heat sensitive stencil paper sheets which can be perforated by irradiation of infrared rays or by means of a thermal head are conventionally known. A typical one of the conventional heat sensitive stencil paper sheets includes a heat sensitive film and a porous thin paper sheet adhered to the heat sensitive film using a bonding agent. A stencil paper printing apparatus using a single cylinder, such as shown in FIG. 8, is known for using this described conventional heat sensitive stencil paper sheet. Referring to FIG. 8, the stencil paper printing apparatus includes a plate cylinder 62 which has a perforated photosensitive stencil paper sheet 64 wound on an outer periphery thereof with its porous support member positioned on the inner side. Ink is supplied from the inside toward the outer periphery of the plate cylinder 62. A press roller 66 is contacted under pressure with the plate cylinder 62 with printing paper 68 interposed therebetween while the plate cylinder 62 is driven to rotate to effect printing on the printing paper 68.

Shown in FIG. 9 is a second type of conventional stencil paper printing apparatus. Referring to FIG. 9, the stencil paper printing apparatus uses a heat sensitive stencil paper sheet 70 formed of a heat sensitive film. A porous support member 84 is adhered to the heat sensitive film and has a frame member 72 provided along a periphery of the porous support member 84. The porous support member 84 serves as an ink applying portion and is enclosed by the frame member 72 and an ink-impermeable cover sheet 74.

The stencil paper printing apparatus includes a pressing member 78, a receiving table 80 disposed in an opposing relationship to the pressing member 78, and a holding member 82 disposed at a peripheral portion of the face of the pressing member 78, opposed to the receiving table 80, for holding the heat sensitive stencil paper sheet 70 thereon. Ink is applied to the porous support member 84, surrounded by the frame member 72, of the perforated heat sensitive stencil paper sheet 70. Then the porous support member 84 and the frame member 72, attached on one side to heat sensitive stencil paper sheet 70, are covered with the cover sheet 74 on the opposite side prior to mounting on the pressing member 78. The heat sensitive stencil paper sheet 70 is held on the pressing member 78 by the holding member 82 and the pressing member 78 is moved toward, and pressed against, the receiving table 80 with printing paper 86 interposed therebetween to effect printing on the printing paper 86.

A stencil paper printing apparatus of the cylinder type described above has a large size. Since it can be used to print large stencils, it has a comparatively high running cost when required to print comparatively small amounts of material, i.e. only a small portion of the stencil has printing perforations.

On the other hand, the pressing type stencil paper printing apparatus has a comparatively small size. However, it has a disadvantage in that the user must apply the ink. Therefore, the hands or the clothes of the user may be soiled when the ink is applied and, since the ink is not readily applied with a uniform thickness, a regular print may not be obtained.

In order to improve the drawbacks of the conventional stencil paper printing apparatuses described above, the applicant of the present invention described, in Unexamined Japanese Patent Provisional Publication No. 4-166390 (published Jun. 12, 1992), a plate for stencil paper printing as shown in FIG. 10.

Referring to FIG. 10, the stencil plate 50 includes successive layers of a heat sensitive stencil paper sheet 56 formed of a thermoplastic film 52 and a porous support member 54 adhered to the thermoplastic film 52, a non-woven fabric 58 disposed on the heat sensitive stencil paper sheet 56 adjacent to the porous support member 54 and impregnated with ink, and an ink-impermeable film 59 serving as a base member. A perforation image is formed on the stencil plate 50 by heat melting the thermoplastic film 52 of the heat sensitive stencil paper sheet 56 by means of a stenciling apparatus which employs, for example, a thermal head. Such formation of a perforation image will be hereinafter referred to as stenciling.

The stencil plate 50, thus stenciled, is mounted onto a stamping member provided with a grip and the stamping member is pressed against printing paper to effect stencil paper printing.

However, with the stencil plate, when it is stenciled, for example, by means of a thermal head, a small amount of ink oozes from the perforation portions and, accordingly, there is the possibility that ink may stick to the thermal head and also to the face (printing face) of the thermoplastic film of the stencil plate.

A stencil plate which solves the above identified problem has been developed and is shown in FIG. 11. Referring to FIG. 11, the stencil plate 10 includes, as principal components thereof, a heat sensitive stencil paper sheet 12, a separator 14, a non-woven fabric 16 impregnated with ink, a frame member 18 disposed so as to surround the non-woven fabric 16, and an ink-impermeable film 20 serving as a base member.

The heat sensitive stencil paper sheet 12 includes, as shown in FIG. 13, a thermoplastic film 22, a bonding agent layer 24, and a porous support member 26. The thermoplastic film 22 is formed of a polyethylene terephthalate film (hereinafter referred to as PET film) approximately 2 μm thick, but may alternatively be formed of a film of, for example, polypropylene or copolymer of vinylidene chloride-vinyl chloride. Preferably the PET film is 1 to 4 μm thick. A thickness, of the PET film, of less than 1 μm results in high production costs and does not provide sufficient strength. Accordingly, the PET film of such thickness is not suitable for practical use. The porous support member 26 is formed of thin porous paper which is made of, as a principal material, for example, natural fiber of Manila hemp, kozo (paper mulberry =Broussonetia kazinoki) or mitsumata (Edgeworthia papyrifera), synthetic fiber of polyethylene terephthalate, polyvinyl alcohol or polyacrylonitrile or semisynthetic fiber of rayon. The heat sensitive stencil paper sheet 12 structured as described above adheres, at four sides thereof, to the frame member 18 by means of a bonding agent layer 28 as shown in FIG. 12.

An opening 17 having a size corresponding to the size of the non-woven fabric 16 is formed at a central portion of the frame member 18 as shown in FIGS. 11 and 12. A small hole 19 for removing the separator 14 there-through is formed at a right portion of the frame member 18 (as shown in FIGS. 11 and 12). Since the ink impregnated in the non-woven fabric 16 is an oil ink, the frame member 18 is made of a material which is not attacked by oil ink, such as, for example, vinyl chloride, polypropylene, polyethylene, polyacetal or polyethylene terephthalate.

The non-woven fabric 16 is impregnated, in a saturated condition, with the oil ink so that when a pressure is applied to it, the ink impregnated therein oozes from the non-woven fabric 16. The non-woven fabric 16 is made of a synthetic fiber of polyethylene, polypropylene or polyethylene terephthalate. Preferably the thickness of the non-woven fabric 16 is set greater than one half but smaller than three times the thickness of the frame member 18. Upon stenciling, while the heat sensitive stencil paper sheet 12 is moved by transporting the frame member 18, it is perforated by heat of a thermal head. Accordingly, if the thickness of the non-woven fabric 16 is excessively small, the heat sensitive stencil paper sheet 12 will sink into, upon stenciling, the inside of the frame member 18 and be moved out of contact with the thermal head thereby resulting in a failure to achieve complete perforation. On the other hand, if the thickness of the non-woven fabric 16 is excessively great, then it projects from the frame member 18 to be compressed against the thermal head. In this condition, the stencil plate 10 is prevented or hindered from being transported regularly by the frame member 18 during stenciling. Accordingly, because the stencil plate 10 is not transported properly in the predetermined pitch, or is transported obliquely due to the non-uniform thickness of the non-woven fabric 16, the perforations are improperly positioned. Preferably, the non-woven fabric 16 is set so that it is compressed, upon stenciling, by the pressing force of the thermal head so that it presents a thickness equal to that of the frame member 18.

The separator 14 is disposed between the heat sensitive stencil paper sheet 12 and the non-woven fabric 16. A portion thereof, shown in FIG. 12 as a right portion, extends through the small, oblong hole 19 formed in the frame member 18 and further between the frame member 18 and the film 20 to project beyond the end of the stencil plate 10.

The size of the separator 14 is set to be greater than the size of the non-woven fabric 16. More particularly, referring to FIG. 12, the area the separator 14 covers beyond the non-woven fabric 16 is defined by a chain line shown on the frame member 18. The separator 14 may be formed of mold separating paper produced by applying a silicon film to wood-free or glassine paper or of a resin film of polyethylene terephthalate or ethylene tetrafluoride (trade name: TEFLON). The material of the separator 14 is required to have the characteristic that it is low in wettability and, more particularly, the wetting angle is 45 degrees or more. Further, when mold separating paper or the like is employed, preferably a silicon film is formed not only on the face of the mold separating paper contacting the non-woven fabric 16 but also on the other face as well. When the wettability is high, or a silicon film is formed on only one face of the mold separating paper or the like, the ink may spread to the heat sensitive stencil paper sheet 12 side of the separator 14 and there is the possibility that, when perforations are formed, ink may ooze from the perforation portions.

The ink impermeable film 20, which serves as a base member, has a bonding agent layer 32 applied to an upper face (slanting line portion in FIG. 12) for adherence to the frame member 18 and the non-woven fabric 16. The film 20 is formed of a film of a resin which is not attacked by oil ink such as vinyl chloride, polypropylene, polyethylene or polyethylene terephthalate.

The stencil plate 10 described above is stenciled using a stenciling apparatus (not shown). Such a stenciling apparatus mirror-image prints the face of the thermoplastic film 22 of the heat sensitive stencil paper sheet 12 by means of a thermal head to heat the thermoplastic film 22 to melt and perforate same. When stenciling, the thermal head is pressed against the stencil plate 10 under a predetermined pressing force and, in this instance, since the separator 14 is disposed between the heat sensitive stencil paper sheet 12 and the non-woven fabric 16, even if the thermoplastic film 22 of the heat sensitive stencil paper sheet 12 is perforated, ink does not ooze from the perforation portions.

The stencil plate 10, stenciled in this manner, is mounted onto a stamping member 34 (shown in FIG. 14). The stamping member 34 consists of a handle portion 36, a cushion layer 38 and an adhesive layer 40. The stencil plate 10 is mounted onto the stamping member 34 by adhering the film 20 side of the stencil plate 10 to the adhesive layer 40 of the stamping member 34. Thereafter, the separator 14 (shown in FIG. 12) is pulled from the stencil plate 10. The stamping member 34 can then be pressed against a printing paper 42, whereupon the non-woven fabric 16 is compressed so that ink oozes from the perforated portions of the printing face of the stencil plate 10 and is transferred to the printing paper 42.

The conventional stencil plate 10, however, has several problems, such as the formation of irregular perforations caused by slippage between the separator 14, having a low wettability, and the heat sensitive stencil paper sheet 12 upon formation of an image on the heat sensitive stencil paper sheet 12, soiling of the thermal head of the perforating stenciling apparatus caused by ink oozing from an end face of the separator 14 to the heat sensitive stencil paper sheet 12 side, and the production of wrinkles in the heat sensitive stencil paper sheet 12 upon stamping caused by the admission of air between the non-woven fabric 16 and the heat sensitive stencil paper sheet 12 upon removal of the separator 14 after formation of an image.

SUMMARY OF THE INVENTION

It is an object of the invention to provide a stencil plate which does not cause the formation of irregular perforations, cause soiling to a head of a perforating stenciling apparatus upon perforation, or cause the production of wrinkles on a heat sensitive stencil paper sheet upon stamping.

In order to attain the object described above, according to one aspect of the invention, there is provided a stencil plate which comprises a heat sensitive stencil paper sheet formed of a thermoplastic film and a porous support member adhered to the thermoplastic film, an impregnated member disposed on the heat sensitive stencil paper sheet adjacent to the porous support member and impregnated with ink, an ink-permeable base member on which the heat sensitive stencil paper sheet and the impregnated member are layered successively, and a thin film peelably provided on a surface of the heat sensitive stencil paper sheet and having a heat resisting property higher than the thermoplastic film.

In the stencil plate, the high temperature heat resisting thin film is not perforated by a stenciling apparatus employing a thermal head. Only the heat sensitive stencil paper sheet is perforated to stencil the stencil plate. Thus, if the stenciled plate is mounted onto a stamping member, the high temperature heat resisting thin film is peeled from the heat sensitive stencil paper sheet and thereafter the stamping member is pressed against printing paper, then the ink in the impregnated member is forced from the perforation portions of the heat sensitive stencil paper sheet to thereby effect stencil paper printing.

With the stencil plate, since the thin film, having a heat resisting property higher than that of the thermoplastic film of the heat sensitive stencil paper sheet, is peelably provided on the surface of the heat sensitive stencil paper sheet, the heat sensitive stencil paper sheet does not suffer from irregular formation of perforations, no ink sticks to a thermal head for stenciling the stencil plate, and, upon stamping, no wrinkles are produced on the heat sensitive stencil paper sheet.

According to another aspect of the invention, there is provided a stencil plate, which comprises a thin film having a high temperature heat resisting property and peelably provided on a surface of a heat sensitive stencil paper sheet and a peelable member adhered to at least part of the thin film for peeling the thin film from the heat sensitive stencil paper sheet.

The stencil plate after stenciling is mounted onto a stamping member, and the thin film is peeled from the heat sensitive stencil paper sheet making use of the peelable member.

With the stencil plate, using the thin film, having a higher temperature heat resisting property than the heat sensitive stencil paper sheet, that will be peeled away after stenciling, the thin film, which is not very strong by itself, is stiffened by the peelable member, which facilitates handling of the thin film and, consequently, no ink will stick to the hand or clothes of the user.

The above and other objects, features and advantages of the invention will become apparent from the following description and the appended claims, taken in conjunction with the accompanying drawings in which like parts or elements are denoted by like reference characters.

DESCRIPTION OF THE PREFERRED EMBODIMENTS

Figure 1:
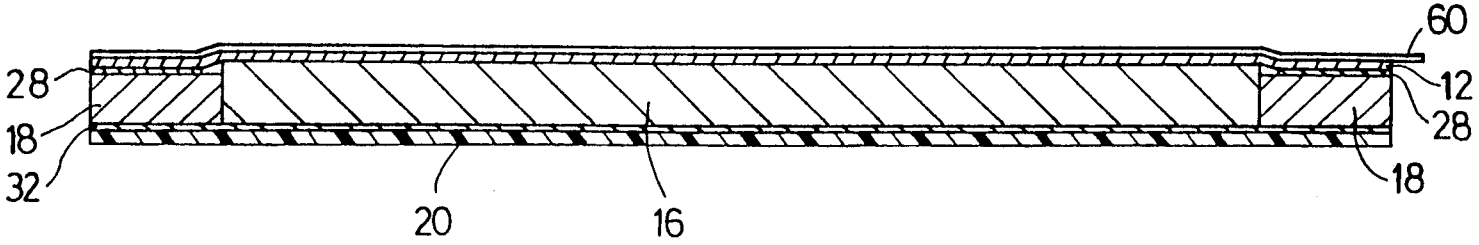
FIG. 1 is a sectional view of a stencil plate in a preferred embodiment according to the invention.
Figure 2:
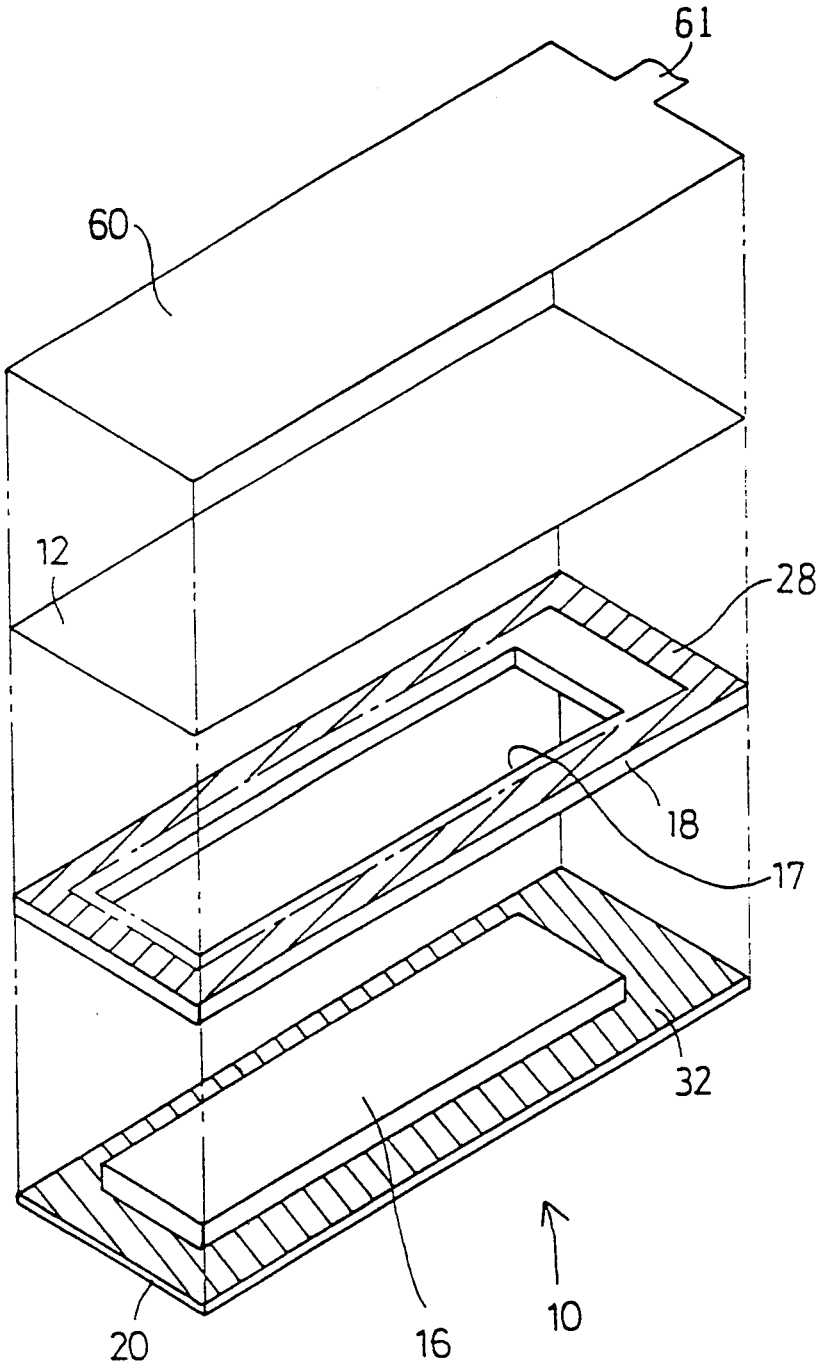
FIG. 2 is an exploded perspective view of the stencil plate shown in FIG. 1.

Referring to FIGS. 1 and 2, there is shown a stencil plate of a preferred embodiment according to the invention. The stencil plate includes, as principal components thereof, a surface film 60, a heat sensitive stencil paper sheet 12, an non-woven fabric 16 impregnated with ink, a frame member 18 disposed so as to surround the non-woven fabric 16, and an ink-impermeable film 20 serving as a base member.

The heat sensitive stencil paper sheet 12 is adhered, at the four sides thereof, to the frame member 18 by means of a bonding agent layer 28 as shown in FIG. 2.

The frame member 18 has an opening 17 formed at a central portion thereof. Opening 17 has a size corresponding to the size of the non-woven fabric 16.

The non-woven fabric 16 is impregnated, in a saturated condition, with oil ink and is fixed to the film 20 to that, when a pressure is applied to the non-woven fabric, the ink impregnated therein in oozes from it.

The film 20 is adhered to the rear face of the frame member 28 by means of a bonding agent layer 32 indicated by slanting lines in FIG. 2.

The surface film 60 adheres to the heat sensitive stencil paper sheet 12 in a closely contacting relationship so that no air layer is formed between them. In the preferred embodiment, silicon grease is used as the bonding agent for adhering surface film 60 and the heat sensitive stencil paper sheet 12. The bonding agent must have the characteristic that it is strong against a peeling force acting in a direction of 0 degree, that is, parallel to the plane defined by frame member 18, in order to prevent a lateral displacement between the heat sensitive stencil paper sheet 12 and the surface film 60 during perforation when a thermal head is pressed against the surface film 60, but is weak against a peeling force acting in the direction between 90 and 180 degrees to the plane of the frame member 18, that is between a right angle and a directly opposite direction, so that the surface film 60 may be peeled readily from the heat sensitive stencil paper sheet 12 after formation of an image on the heat sensitive stencil paper sheet 12.

The surface film 60 has a high temperature heat resisting property that is higher than that of the thermoplastic film 22 of the heat sensitive stencil paper sheet 12 and preferably has a high temperature heat resisting temperature that is at least higher by 50° C. or more than that of the heat sensitive stencil paper sheet 12. The surface film 60 and the thermoplastic film 22 may be, for example, a combination of, as the thermoplastic film 22, a PET film of 1 to 2 μm thick having a high temperature heat resisting temperature of approximately 120° C. during continuous heating and, as the surface film 60, a thin film of a metal of 3 μm or less thickness having a heat resisting temperature equal to or higher than 180° C. during in continuous heating, such as titanium, aluminum or silver, or a film of polyether ether ketone or polyether sulfone. In the present embodiment, a PET film 2 μm thick is employed as the thermoplastic film 22 while an aramid film (para-aromatic polyamide: APA) 3 μm thick is employed as the surface film 60.

Figure 3:
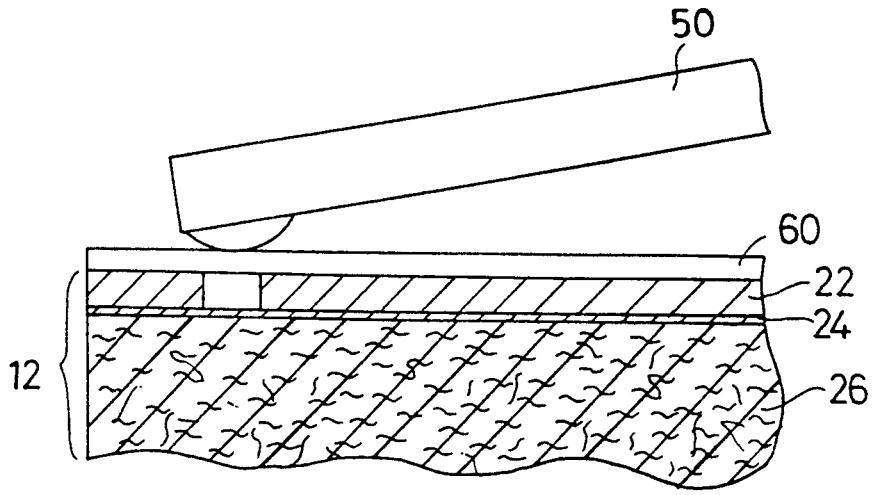
FIG. 3 is a schematic sectional view showing the stencil plate of FIG. 1 when a perforation is formed.

Heat is applied to the stencil plate 10 from above the surface film 60, by means of a thermal head 50 of a stenciling apparatus as shown in FIG. 3. Because of the difference between the heat resisting temperatures of the surface film 60 and the thermoplastic film 22 of the heat sensitive stencil paper sheet 12 during continuous heating, the surface film 60 is not melted by the heat from the thermal head 50 and only the thermoplastic film 22 is melted so that a perforation image is formed thereon.

Figure 4:
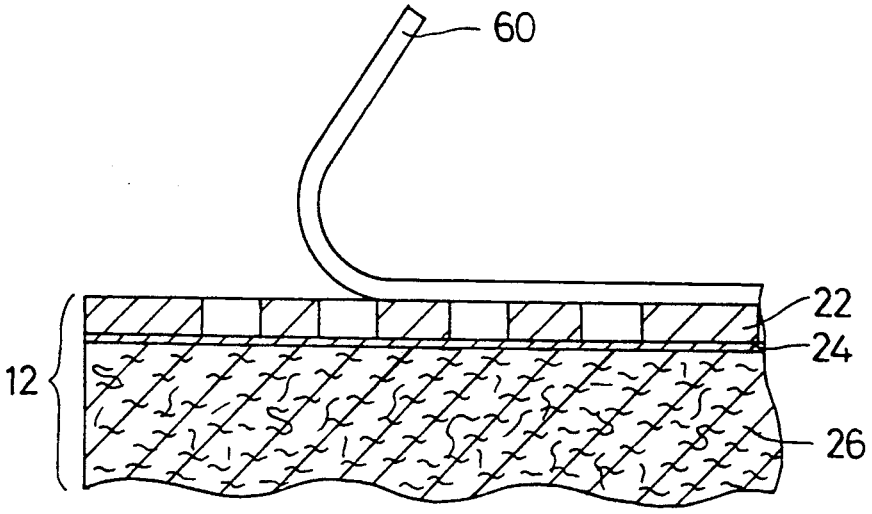
FIG. 4 is a schematic sectional view showing the stencil plate of FIG. 1 when a surface film is peeled from the heat sensitive stencil paper sheet after the formation of the perforations.

After the stenciling, a portion 61 of the surface film 60 which projects beyond the frame member 18, shown in FIG. 2, is manually gripped and pulled in the direction between 90 and 180 degrees from the plane of the frame member 18, as shown in FIG. 4. Consequently, the surface film 60 is peeled from the stenciled face of the stencil plate 10.

Figure 14:
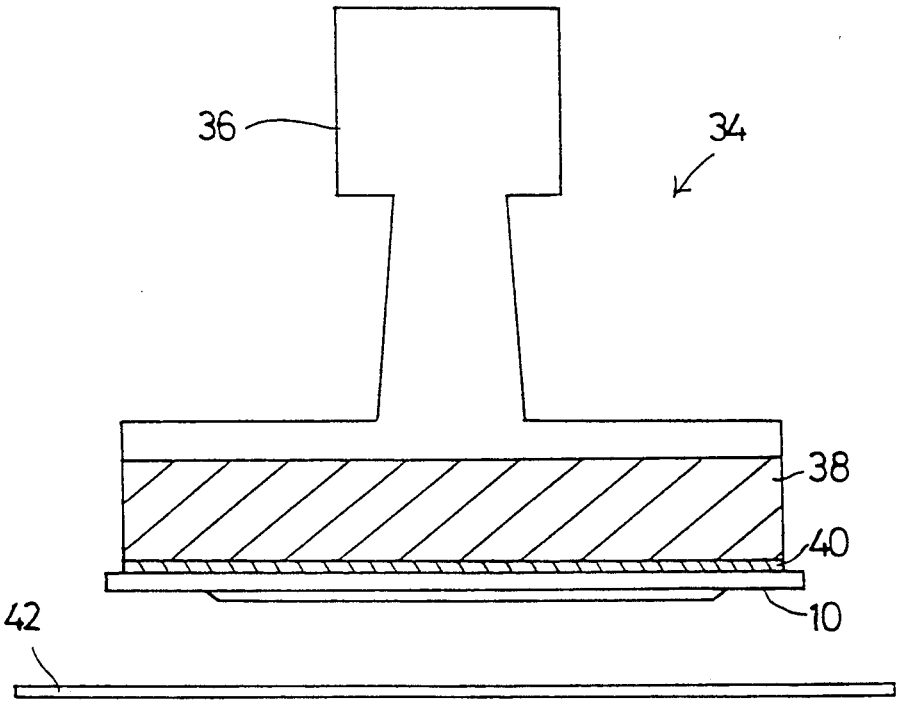
Fig.14 RELATED ART
FIG. 14 is a schematic view showing a stencil plate mounted on a stamping member.

In this condition, the stencil plate 10 will be mounted, such as shown in FIG. 14, onto the stamping member 34 by adhering the film 20 face side thereof to the adhesive layer 40 of the stamping member 34, and then the stamping member 34 will be pressed against printing paper 42. Consequently, the non-woven fabric 16 is compressed so that the ink impregnated in it oozes from the perforation portions of the printing face of the stencil plate 10 thereby transferring the ink to the printing paper 42.

Because of the structure described above, the stencil plate 10 is advantageous in that it does not cause formation of irregular perforations since the surface film 60 and the heat sensitive stencil paper sheet 12 are held in close contact with each other, it does not cause sticking of ink to the thermal head 50 since the surface film 60 is interposed between the heat sensitive stencil paper sheet 12 and the thermal head 50, and it does not produce wrinkles on the heat sensitive stencil paper sheet 12 upon stamping since no air is admitted between the heat sensitive stencil paper sheet 12 and the non-woven fabric 16.

Figure 5:
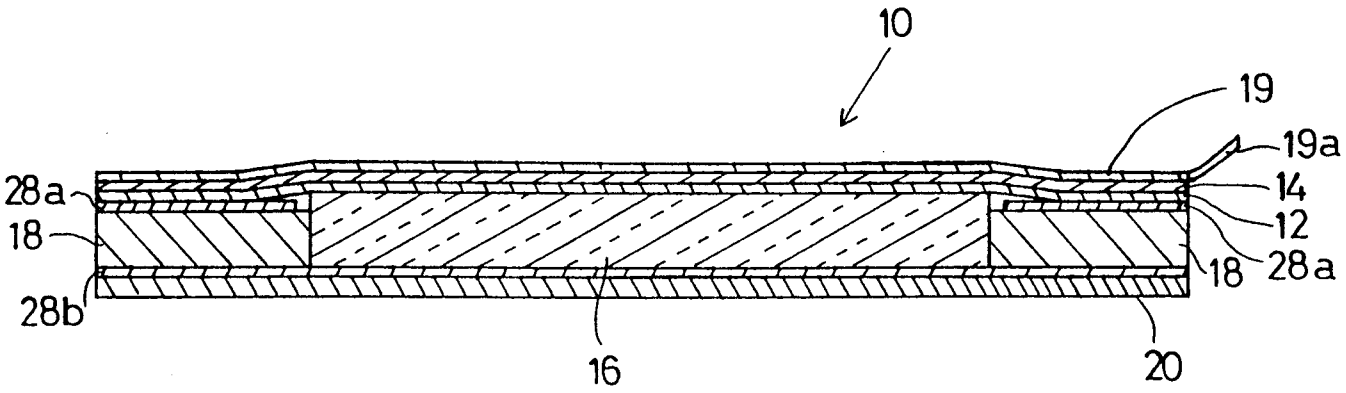
FIG. 5 is a sectional view of another stencil plate in a second embodiment according to the invention.
Figure 6:
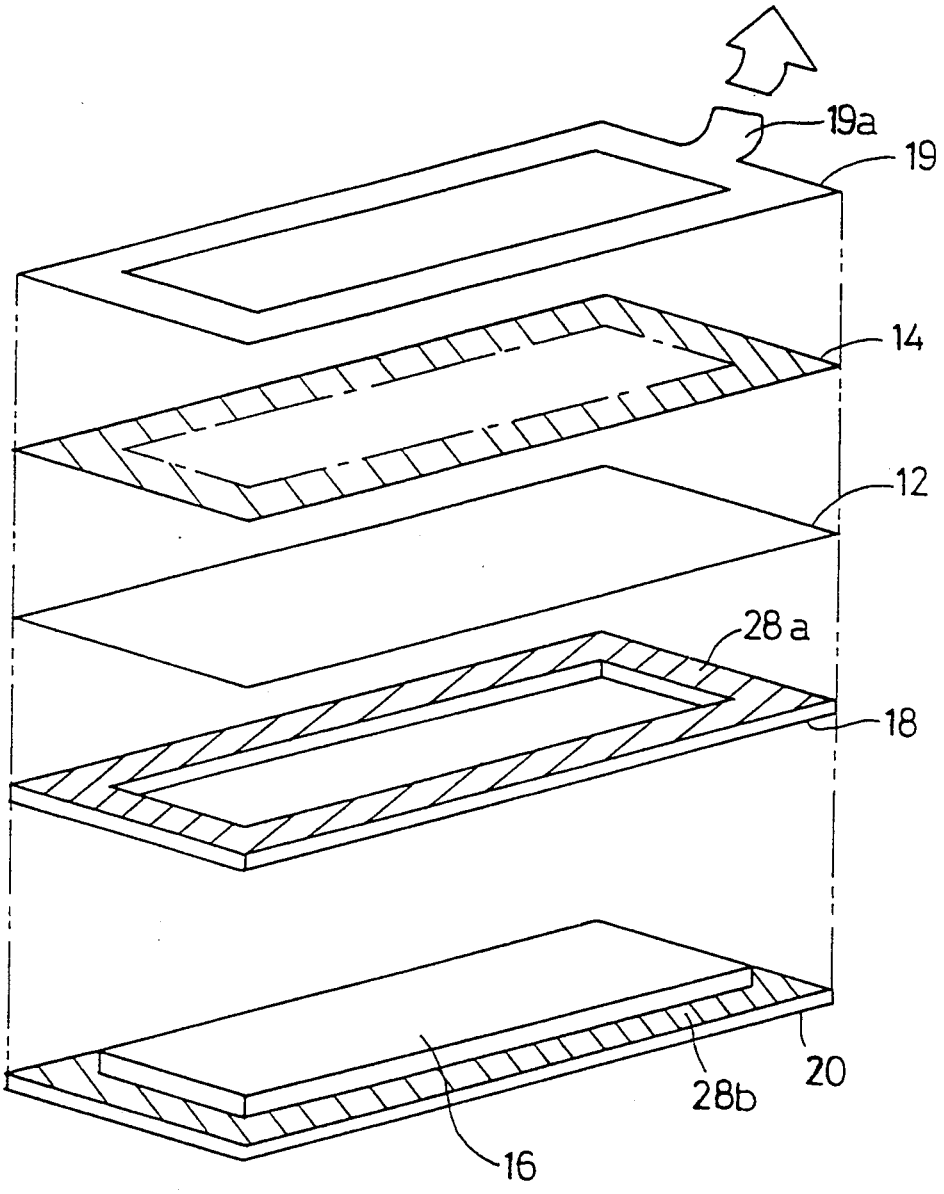
FIG. 6 is an exploded perspective view of the stencil plate shown in FIG. 5.

FIGS. 5 and 6 show a stencil plate 10 in a second preferred embodiment according to the invention. The stencil plate 10 includes a peelable member 19, a surface film 14, a heat sensitive stencil paper sheet 12, a non-woven fabric 16 impregnated with ink, a frame member 18 disposed so as to surround the non-woven fabric 16, and an ink-impermeable film 20 serving as a base member. The elements are layered successively from top to bottom in the order described.

The surface film 14 is formed of a high temperature heat resisting thin film and is adhered to the heat sensitive stencil paper sheet 12 by means of a bonding agent 28*a* in such a closely contacting condition that no air layer is formed between them. The bonding agent 28*a* is required to have the characteristic that it is strong against a peeling force acting in direction parallel to the plane of the heat sensitive stencil paper sheet 12, that is a direction of 0 degree, but is weak against a peeling force acting in the direction between 90 and 180 degrees relative to the plane, that is at a right angle up to a directly opposite direction. In the present embodiment, silicon grease is employed as the bonding agent.

The surface film 14 is formed of a thin film of no more than 4 μm thickness having a heat resistance temperature equal to or higher than 180° C., such as, for example, a thin film of a metal, such as titanium, aluminum, silver or gold or a thin film of polyether ether ketone or polyether sulfone. In the present embodiment, an aramid film (para aromatic polyamide; APA) is used for the surface film 14.

The peelable member 19 includes a base member formed of paper or a plastic film and an adhesive layer (not shown) of the acrylic type or the silicon type applied to the base member. The peelable member 19 is adhered to the surface film 14 by the action of the adhesive layer. While it is possible to apply the peelable member 19 in advance to the surface film 14, preferably the peelable film 19 is applied to the surface film 14 at the last stage of production of the stencil plate 10.

When the stencil plate 10, described above, is stenciled by a known stenciling apparatus, for example, a thermal head (not shown), since the difference between the continuous duty temperatures of the surface film 14 and the thermoplastic film of the heat sensitive stencil paper sheet 12 is great, the surface film 14 is not melted by heat from the thermal head but the thermoplastic film is melted by the heat so that a perforated image is formed thereon.

Then, the projecting portion 19*a*, of the peelable member 19 adhered to the surface film 14, which projects from the frame member 18, is manually gripped and pulled out in the direction of the arrow mark (FIG. 6). As a result, the surface film 14, which is adhered to the peelable member 19 by an action of the adhesive layer of the peelable member 19, is gradually peeled back and removed from the stenciled face so that the heat sensitive stencil paper sheet 12 in the stenciled condition is exposed.

Then, the stenciled plate 10 can be fixed to a stamping member 34, such as shown in FIG. 14, which includes a handle portion 36, a cushion layer 38 and an adhesive layer 40 and is used to print on printing paper 42.

As described, the stencil plate 10 in the present embodiment has the surface film 14, in the form of a thin film having a high temperature heat resisting property, that is peelably provided on the surface of the heat sensitive stencil paper sheet 12. Thus, when the stencil plate 10 is stenciled by means of a thermal head or the like serving as stenciling means, ink does not ooze from the perforated portions of the heat sensitive stencil paper sheet 12. Further, when the surface film 14 is peeled from the heat sensitive stencil paper sheet 12 after stenciling, since it is peeled from the heat sensitive stencil paper sheet 12 using the peelable member 19, the heat sensitive stencil paper sheet 12, which is not very stiff by itself, is stiffened by the peelable member 19 to facilitate handling of the heat sensitive stencil paper sheet 12 and, consequently, prevents ink from sticking to the hands or clothes of the user.

It is to be noted that the invention is not limited to the specific embodiments described hereinabove, but can be embodied in various forms without departing from the spirit and scope of the invention.

Figure 7:
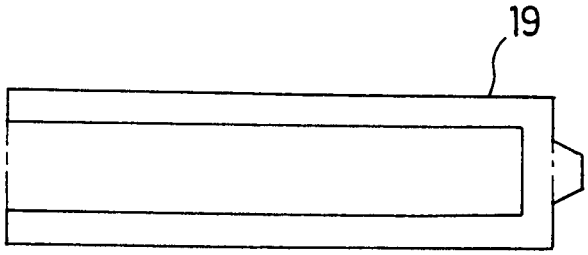
FIGS. 7(*a*), 7(*b*) and 7(*c*) are plan views showing different shapes of a peelable member.
Figure 7:
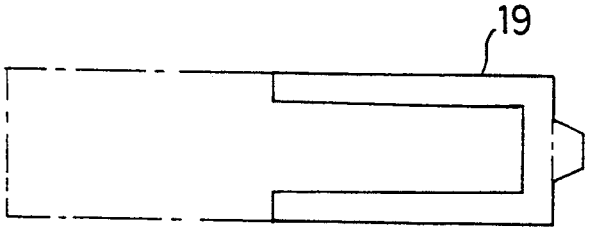
Figure 7:
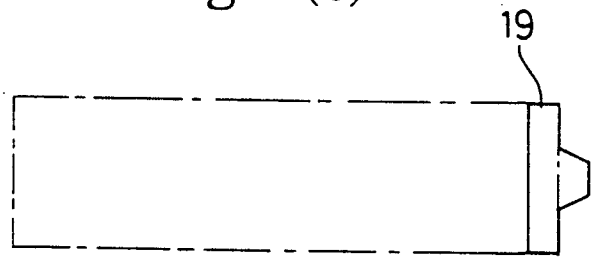
Figure 8:
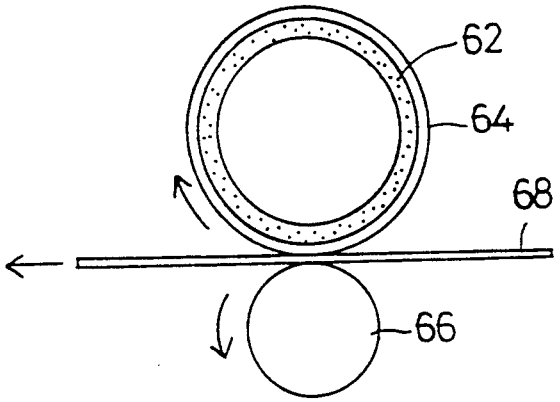
Fig.8 RELATED ART
FIG. 8 is a schematic view showing the general construction of a conventional stencil apparatus of the single cylinder type.
Figure 9:
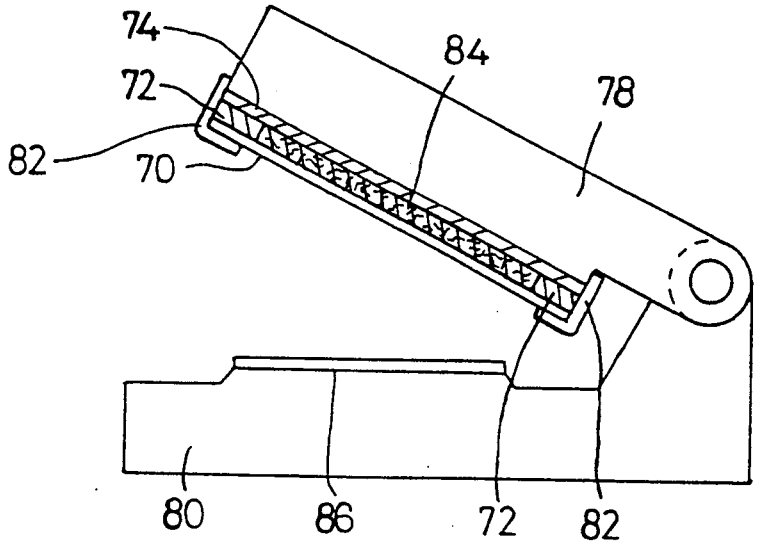
Fig.9 RELATED ART
FIG. 9 is a schematic view showing the general construction of a conventional stencil apparatus of the pressing type.
Figure 10:
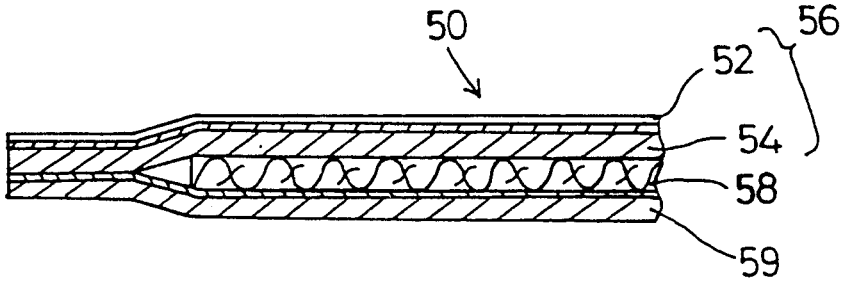
Fig.10 RELATED ART
FIG. 10 is a sectional view of a conventional stencil plate.
Figure 11:
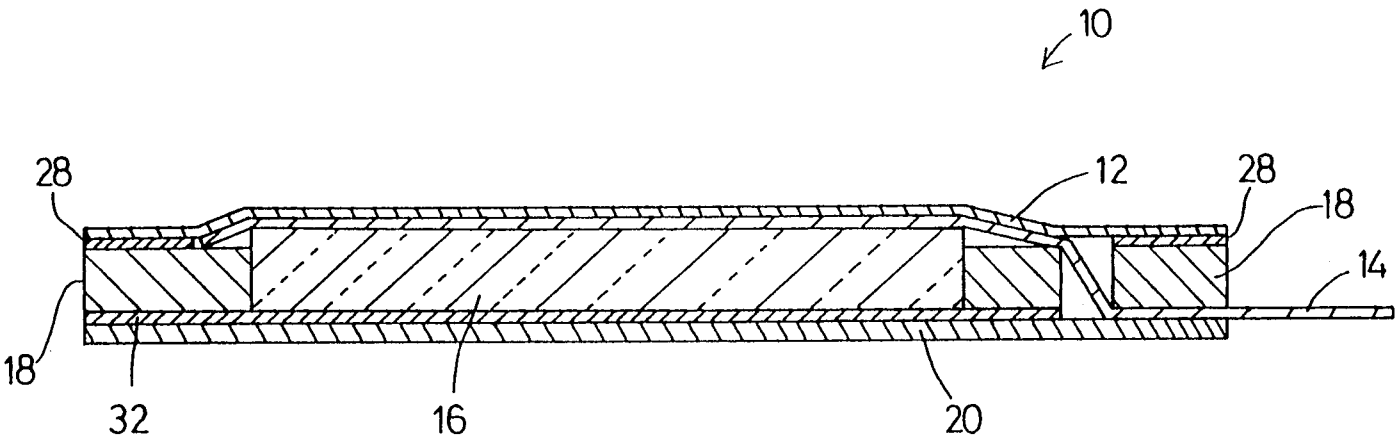
Fig.11 RELATED ART
FIG. 11 is a sectional view of a second conventional stencil plate.
Figure 12:
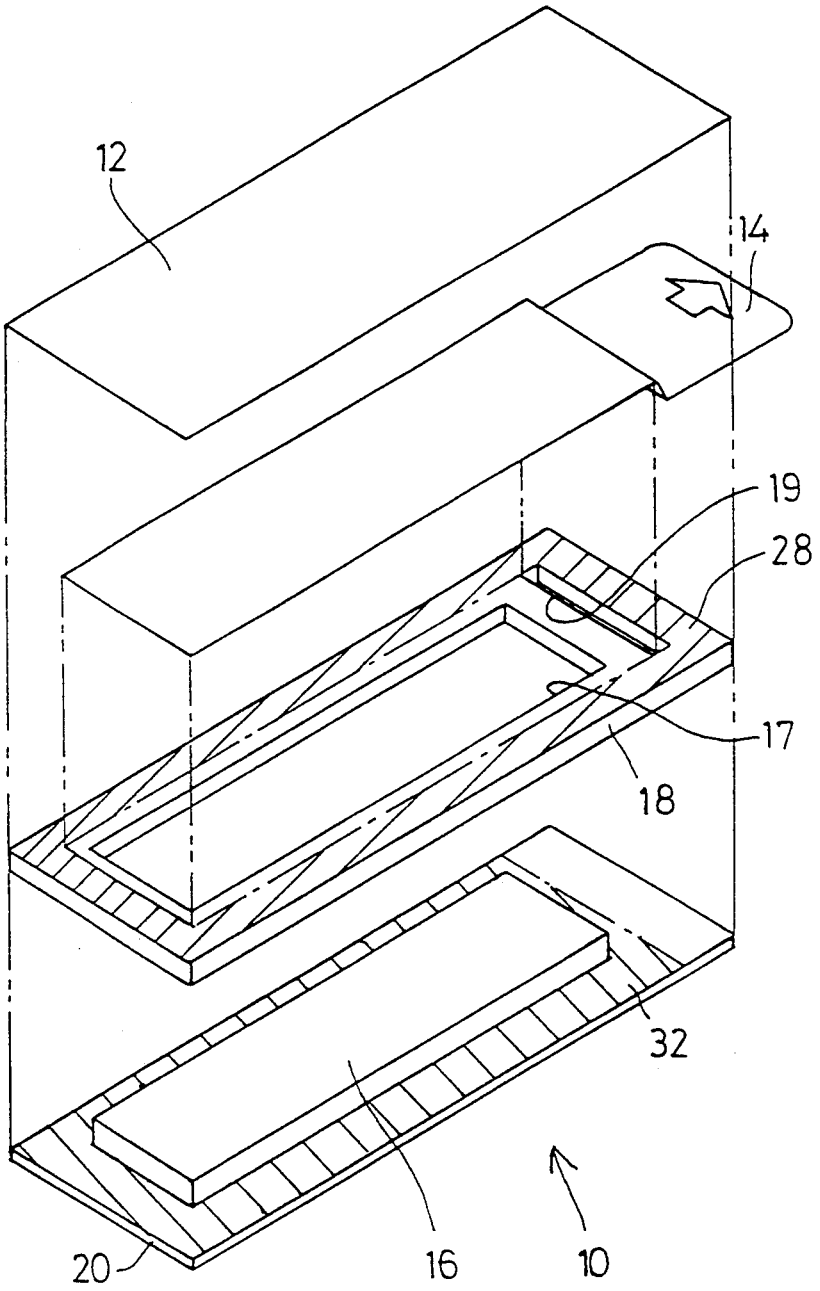
Fig.12 RELATED ART
FIG. 12 is an exploded perspective view of the stencil plate shown in FIG. 11.
Figure 13:
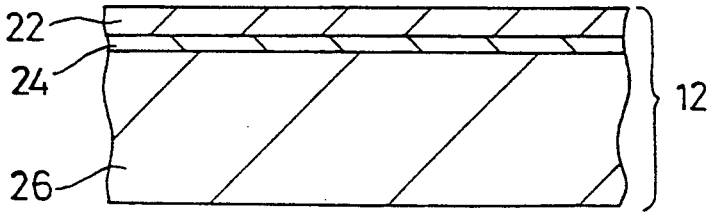
Fig.13 RELATED ART
FIG. 13 is a partial sectional view of a conventional heat sensitive stencil paper sheet.

For example, while, in the second embodiment described above, the peelable member 19 is formed as a member having a frame-like configuration so that it surrounds the printing face of the heat sensitive stencil paper sheet 12, it may otherwise be formed as a member having any of the configurations shown in FIGS. 7(*a*) to 7(*c*) if it facilitates peeling of the surface film 14.

What is claimed is:

1. A stencil plate comprising:

a heat sensitive stencil paper sheet formed of a thermoplastic film and a porous support member adhered to the thermoplastic film;

an impregnated member impregnated with ink disposed on the heat sensitive stencil paper sheet adjacent to the porous support member;

an ink-impermeable base member on which the heat sensitive stencil paper sheet and the impregnated member are layered successively; and a thin film peelably provided on a surface of the heat sensitive stencil paper sheet, said thin film having a high temperature heat resisting property higher than the thermoplastic film.

2. The stencil plate according to claim 1, wherein the thin film having the high temperature heat resisting property peelably provided on the surface of the heat sensitive stencil paper sheet has a peelable member adhered to at least part of the thin film for peeling the thin film from the heat sensitive stencil paper sheet.

3. The stencil plate as claimed in claim 1, further comprising a bonding agent for releasably adhering said thin film to said heat sensitive stencil paper sheet.

4. The stencil plate as claimed in claim 3, wherein said impregnated member is a non-woven fabric pad.

5. A stencil plate, comprising:

a film forming a backing layer;

a frame having a center opening and a first side adhered to said film;

an impregnated member seated in said center opening, said impregnated member saturated with ink;

a stencil paper sheet adhered on a first side to a second side of said frame to enclose said impregnated member; and a surface film releasably adhered at a first side to a second side of said stencil paper.

6. The stencil plate as claimed in claim 5, further comprising a bonding agent for releasably adhering said surface film to said stencil paper.

7. The stencil plate as claimed in claim 6, wherein said bonding agent is a silicone grease.

8. The stencil plate as claimed in claim 5, wherein said stencil paper sheet comprises a thermoplastic film adhered to a porous layer, said porous layer adhered to said frame.

9. The stencil plate as claimed in claim 8, wherein said surface film has a melting point that is at least 50° C. greater than a melting point of said thermoplastic film.

10. The stencil plate as claimed in claim 9, wherein the thermoplastic film has a thickness of 1 to 2 micrometers.

11. The stencil plate as claimed in claim 9, wherein the surface film has a thickness of less than 3 micrometers and is made from one of a group consisting of a metal, polyether ether ketone, polyether sulfone, and para-aromatic polyamide.

12. The stencil plate as claimed in claim 9, wherein the surface film is made of one of a group consisting of titanium, aluminum and silver.

13. The stencil plate as claimed in claim 5, further comprising a peelable member adhered to a second side of said surface film.

14. The stencil plate as claimed in claim 13, wherein said peelable member is frame shaped having an inner opening of a size corresponding to said center opening of said frame.

15. The stencil plate as claimed in claim 5, further comprising a peelable member adhered to a portion of said surface film.

16. The stencil plate as claimed in claim 15, wherein said portion excludes any area corresponding to said center opening of said frame.

17. The stencil plate as claimed in claim 5, wherein said impregnated member is a non-woven fabric pad.

18. A stencil plate, comprising:

an ink impermeable film forming a backing layer;

a frame having a first side adhered to said film, said frame having a center opening therein;

a fabric pad seated in said center opening, said fabric pad saturated with an ink;

a stencil paper sheet comprising a thermoplastic film adhered to a porous backing, said stencil paper sheet adhered by said porous backing to a second side of said frame to enclose said fabric pad;

a bonding agent applied to said thermoplastic film; and a surface film releasably adhered by means of said bonding agent to said stencil paper.

19. A stencil plate as claimed in claim 18, further comprising a peelable member adhered to said surface film, said peelable member for releasably peeling said surface film from said stencil paper sheet.

20. The stencil plate as claimed in claim 19, said peelable member adhered to a portion of said surface film, said portion excluding an area corresponding to said center opening of said frame.

* * * * *